United States Patent [19]

Howlett

[11] Patent Number: 5,046,440

[45] Date of Patent: Sep. 10, 1991

[54] SAIL RIG AND STAYSAIL SYSTEM

[76] Inventor: Ian C. Howlett, Chestnut Cottage, Beaulieu, Hampshire, S042, 7YB, England

[21] Appl. No.: 508,151

[22] Filed: Apr. 11, 1990

[30] Foreign Application Priority Data

Apr. 12, 1989 [GB] United Kingdom ..... 8908276

[51] Int. Cl.[5] ..... B63H 9/06

[52] U.S. Cl. ..... 114/102; 114/103

[58] Field of Search ..... 114/39.1, 95, 102, 103, 114/106

[56] References Cited

U.S. PATENT DOCUMENTS

| | | | |
|---|---|---|---|
| 2,106,209 | 1/1938 | Edge | 114/39.1 |
| 2,968,765 | 7/1976 | Menegus | 114/102 |
| 4,848,258 | 7/1989 | Priebe | 114/102 X |

FOREIGN PATENT DOCUMENTS

| | | | |
|---|---|---|---|
| 1464877 | 11/1965 | France | 114/103 |

*Primary Examiner*—Sherman Basinger

*Attorney, Agent, or Firm*—Notaro & Michalos

[57] ABSTRACT

A sail rig for a sailing vessel or a vessel provided with auxiliary sail propulsion comprises a mast, a continuous yard/boom provided on the mast, a backstay, a main sail located between the mast and the backstay, a forestay and a foresail mounted on the forestay 17. The mast and the yard/boom are rotatable or the yard/boom is rotatable relative to the mast, and the foresail comprises a plurality of ribs spaced apart along the stay and through which the stay extends and an outer covering of flexible material placed in contact with and secured to the ribs.

9 Claims, 2 Drawing Sheets

11
12
15
16
15a
17
18
14
10
13

FIG. 2.
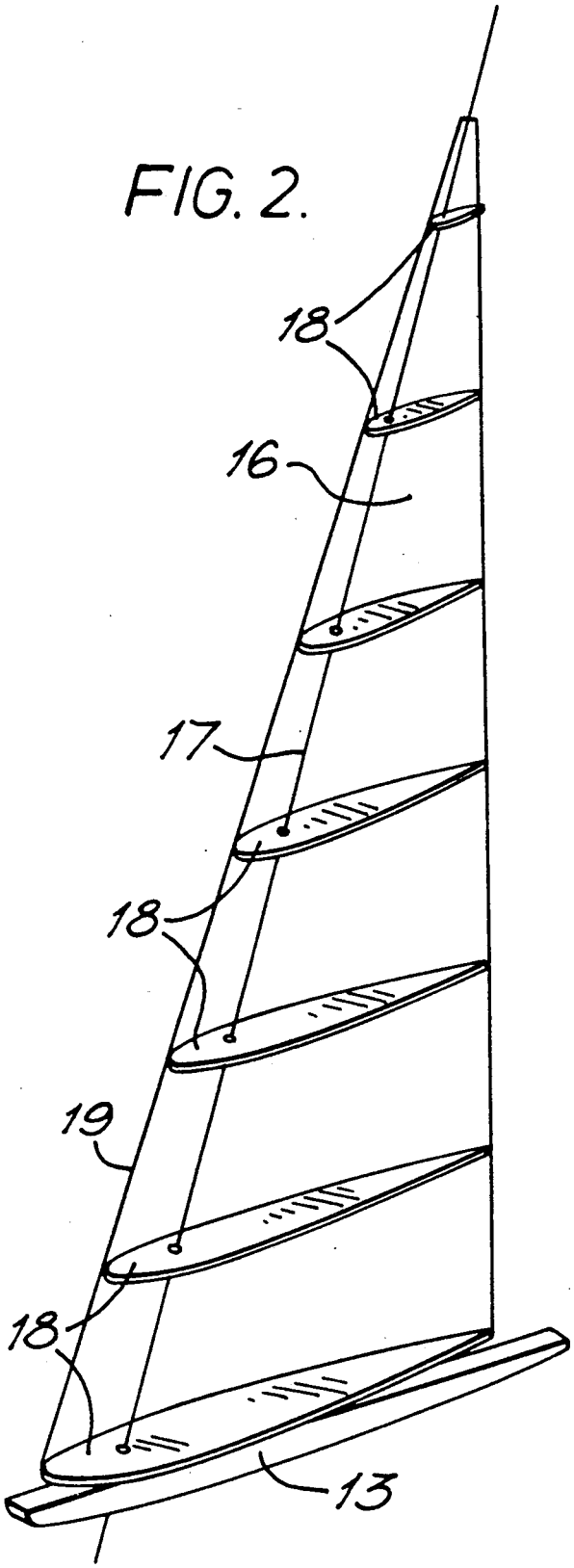
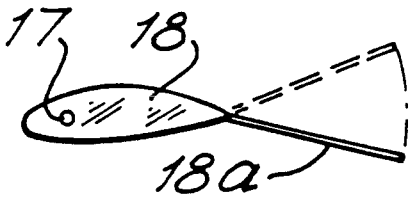
FIG. 3.

SAIL RIG AND STAYSAIL SYSTEM

FIELD AND BACKGROUND OF THE INVENTION

This invention relates to a sail rig for a sailing vessel, such as a yacht, or a vessel provided with auxiliary said propulsion. The invention also relates to a staysail system for such a sailing vessel.

SUMMARY OF THE INVENTION

According to the present invention in one aspect there is provided a sail rig for a sailing vessel or a vessel provided with auxiliary sail propulsion, comprising a mast, a continuous yard/boom provided on the mast, a backstay extending between the upper end of the mast and one end of the yard/boom, a main sail located between the mast and the backstay, a forestay extending between the mast and the other end of the yard/boom and a foresail mounted on the forestay, said mast and said yard/boom being rotatable or said yard/boom being rotatable relative to the mast.

According to the present invention in another aspect there is provided a stay sail for a sailing vessel or a vessel provided with auxiliary sail propulsion, comprising a boom, a stay extending between one end region of the boom and a mast, a plurality of ribs spaced apart along the stay and through which the stay extends, and an outer covering of flexible material placed in contact with and secured to the ribs.

BRIEF DESCRIPTION OF THE DRAWINGS

An embodiment of the invention will now be described, by way of example, with reference to the accompanying drawings, in which:

FIG. 2 is a diagrammatic perspective view of a staysail according to the present invention; and FIG. 3 is a plan view of a modified form of rib showing how the camber along the sail can change.

DESCRIPTION OF THE PREFERRED EMBODIMENT

Figure 1:
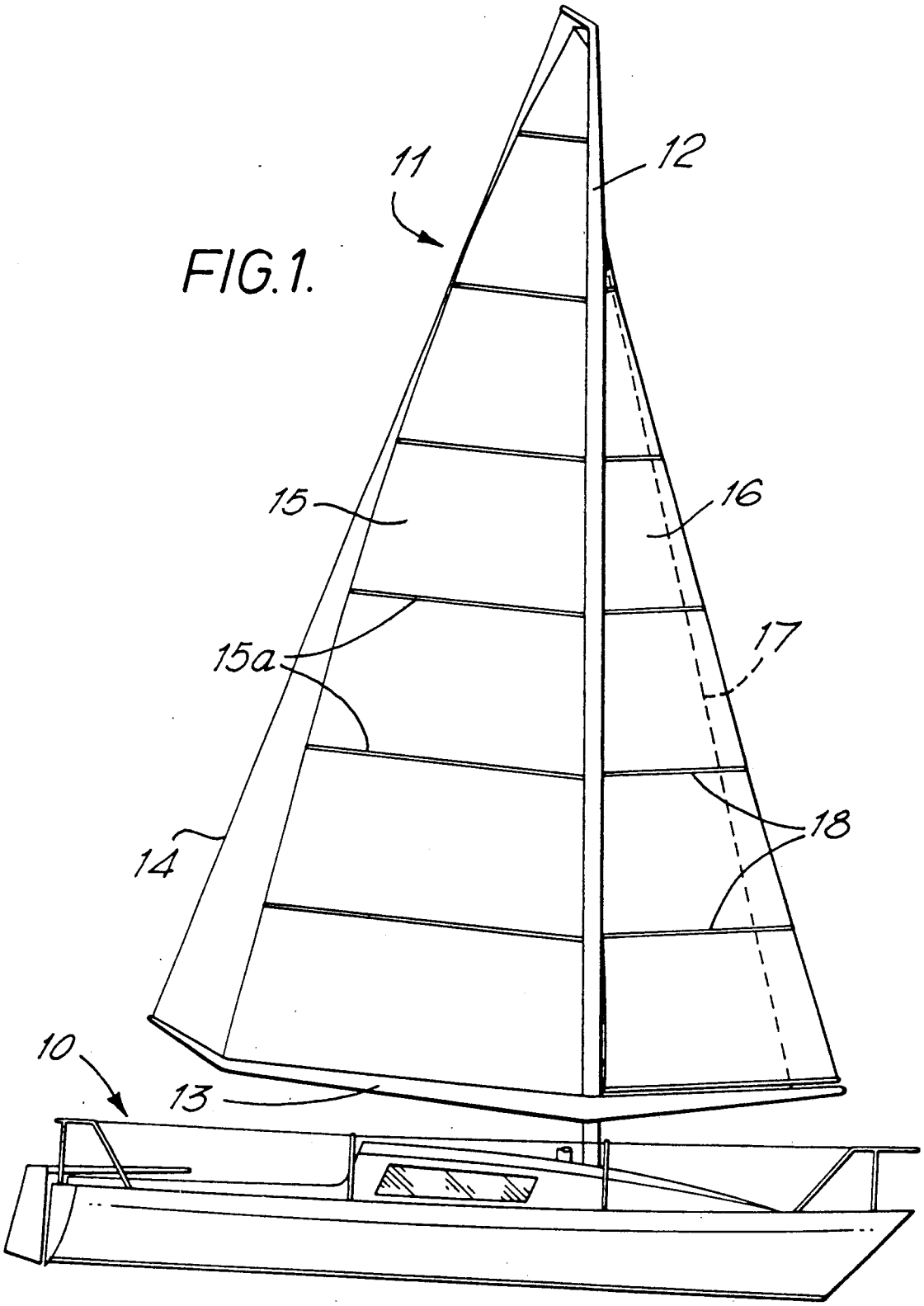
FIG. 1 is a side elevation of a sailing yacht provided with a sail rig according to the present invention.

The sailing yacht 10 shown in FIG. 1 is provided with a sail rig 11 which consists of an unstayed mast 12 which may or may not be of the cantilever type, a continuous yard/boom 13 mounted at the lower end of the mast 12, a backstay 14 which extends between the upper end of the mast 12 and one end of the yard/boom 13, a main sail 15 which is slidable along the mast 12 and is located between the mast 12 and the backstay 14, and a staysail 16 which is set on a forestay 17 which extends between the mast 12 and the other end of the yard/boom 13. The main sail 15 may be stiffened by battens 15*a*.

The tension in the backstay 14 is reacted by the forestay 17. The forestay 17 may or may not be located at the extreme fore end of the staysail 16.

The forces generated by the staysail 16 balance those produced by the main sail 15 and thus the force required to sheet the rig to the desired angle for optimum sailing is reduced.

The entire mast 12 and yard/boom 13 may rotate together about the axis of the mast 12 or the mast 12 can be fixed and the yard/boom 13 may rotate about the fixed mast 12. Mast 12 is connected at its base to the hull of vessel 10. The yard/boom has forward and aft portions which are fixed to each other and extend in opposite directions from the mast.

When sailing the leach tension in the main sail 15 replaces some or all of the tension in the backstay 14 thus maintaining tension in the forestay 17.

Preloading tension in the mast 12 with the backstay 14 is necessary with a cantilever type mast 12 in order to allow for mast deflection when sailing.

The staysail 16 is shown more clearly in FIG. 2 and is generally of an aerodynamic configuration in transverse section. Under wind load the camber of the sail 16 may change along its length. The staysail 16 comprises a plurality of spaced aprt ribs 18 which in plan view have a rounded front end and taper in width to a trailing edge, said ribs 18 being slidably mounted on the forstay 17, and a sail cloth or other flexible material 19 spans the gaps between the ribs 18. The material 19 may be in one piece and extend over each side of the ribs 18 or it may be discontinuous at the ribs 18. The material 19 is fixed to the ribs 18 in any suitable manner. The staysail 16 is erected by a halyard (not shown) and can be reefed in order to reduce its effective sail area.

The use of ribs 18 and the choice of position of the forestay 17 minimises the tensions required to operate and reef the sail 16 efficiently.

The ribs 18 may be formed of wood, or metal, or plastics material which may be fiber reinforced.

The lowest rib 18 and boom 13 may be integral.

FIG. 3 shows a plan view of a modified form of rib 18 which has a flexible trailing end portion 18*a* which allows the camber of the sail to change along its length.

I claim:

1. A sail rig for a vessel having a hull, the rig comprising:

a mast which is unstayed to the hull and which has a base connected to the hull;

a continuous yard/boom mounted to the mast, the yard/boom having forward and aft portions extending in opposite directions from the mast, the forward and aft portions being fixed to each other, yard/boom being rotatable relative to the hull;

a pretensioned backstay extending between and upper end of the mast and outer end of the yard/boom aft portion;

a main sail located between the mast and the backstay;

a pretensioned forestay extending between the mast and an outer end of the yard/boom forward portion, pretensioning of the forestay being transmitted to the pretensioned backstay through the yard/boom;

a staysail mounted to the forestay, the staysail having a leading edge and the forestay being positioned rearwardly of the leading edge; and a plurality of ribs to which the staysail is connected, the ribs being slidably mounted on the forestay.

2. A sail rig as claimed in claim 1, in which the ribs are spaced apart along the forestay and through which the forestay extends, the staysail comprising an outer covering of flexible material placed in contact with and secured to the ribs.

3. A sail rig as claimed in claim 1 or claim 2, in which the staysail is of aerodynamic configuration in transverse section.

4. A sail rig as claimed in claim 2, in which the ribs have a flexible trailing end portion to allow the camber of the staysail to change along its length.

5. A sail rig as claimed in claim 2, in which the ribs in plan view have a rounded front end and taper in width to a trailing edge.

6. A sail rig as claimed in any one of claims 1 or 2, in which the ribs are formed of wood.

7. A sail rig as claimed in any one of the claims 1 or 2, in which the ribs are formed of metal.

8. A sail rig as claimed in any one of claims 1 or 2, in which the ribs are formed of plastics.

9. A sail rig as claimed in any one of the claims 1 or 2, in which the ribs are formed of fiber reinforced plastics.

* * * * *